33-247 SR

11/9/76 OR 3,990,155

33/246

4/27/82

United States Patent [19]

Akin, Jr. et al.

[11] 3,990,155

[45] Nov. 9, 1976

[54] RIFLESCOPE ELEVATION ADJUSTMENT ASSEMBLY

[75] Inventors: Alfred A. Akin, Jr., West Covina; Harold A. Miller, Charter Oak, both of Calif.

[73] Assignee: Bausch & Lomb Incorporated, Rochester, N.Y.

[22] Filed: Dec. 29, 1975

[21] Appl. No.: 644,514

[52] U.S. Cl. ..... 33/247; 33/246; 350/10

[51] Int. Cl.[2] ..... F41G 1/38; G02B 27/36

[58] Field of Search ..... 33/246, 248, 247, 166; 350/10; 356/247

[56] References Cited

UNITED STATES PATENTS

| | | | |
|---|---|---|---|
| 1,361,063 | 12/1920 | Joeck | 33/247 |
| 1,474,209 | 11/1923 | Reynolds | 33/248 |
| 1,985,061 | 12/1934 | Scheller | 33/166 |
| 2,150,629 | 3/1939 | Mossberg | 33/246 |
| 2,165,796 | 7/1939 | Humeston | 33/248 |
| 3,826,012 | 7/1974 | Pachmayr | 33/246 |

*Primary Examiner*—Richard E. Aegerter
*Assistant Examiner*—Richard R. Stearns
*Attorney, Agent, or Firm*—Christie, Parker & Hale

[57] ABSTRACT

A riflescope elevation adjustment assembly which reads directly in terms of target distance in addition to providing conventional "click" elevation settings. The assembly includes an adjustment knob which is externally accessible for rotation without use of tools or removal of parts. A distance scale, appropriately calibrated to the firearm and ammunition in use, is displayed on an annular flange extending from the knob to be positioned within an annular housing secured to the riflescope. The distance scale is viewed through a transparent portion of the housing, and is visible when the firearm is held in a normal aiming position.

7 Claims, 6 Drawing Figures

RIFLESCOPE ELEVATION ADJUSTMENT ASSEMBLY

BACKGROUND OF THE INVENTION

Conventional riflescopes or telescopic sights include windage and elevation adjustments to enable initial "zeroing in" of the sight, and to permit adjustment of the sight for accurate shooting in cross-wind conditions and at different target distances. These adjustments are made by shifting the position of an internal sighting reticle (typically of a crosshair style), or preferably by optically shifting the position of the target image with respect to an always-centered reticle. The latter kind of adjustment is usually made by shifting the position of an internal tubular cell which carries erector lenses used in the riflescope optical system.

Most riflescope elevation or range adjustments include a rotatable dial graduated in minutes of angle, and adjustable only after removal of a protective cover or cap with the rifle held in a non-firing position. An improved adjustment system displays range directly in terms of target distance, and interchangeable yardage scales may be provided to compensate for the trajectories of various rifles and ammunitions. Examples of such improved systems are disclosed in U.S. Pat. Nos. 2,105,564, 2,583,042, 3,484,148 and 3,826,012.

The elevation adjustment of this invention provides a direct-reading distance scale which is enclosed in a housing to be sheltered from weather and impact damage, and which is easily viewed and adjusted while the rifle is held in a normal firing position. Adjustment of the elevation setting does not require tools or removal of parts, and the assembly is provided with a click-stop feature to enable rapid conventional elevation settings to be made if the yardage scale is not used. Different range scales can be used interchangeably in the assembly, and both installation and zeroing of a particular scale is easily achieved without extensive disassembly or use of special tools.

SUMMARY OF THE INVENTION

This invention relates to an external range-adjustment assembly for a riflescope having a tube carrying ocular and objective lenses. An internal means (such as a movable reticle or movable erector-lens cell) is mounted in the tube for adjusting the sight for use with targets at various ranges. The external assembly includes a base secured to a tube, the base defining an upwardly extending annular flange having a transparent viewing portion facing the ocular-lens end of the sight. A knob includes an annular skirt fitted within the base flange, and an externally accessible gripping surface positioned above the base flange. The skirt bears markings forming a distance scale visible through the transparent viewing portion. An elevation adjustment member has a head connected to the knob, and a portion extending into the tube to contact the internal adjusting means. The sight is adjusted for use at a particular target distance by rotating the knob until the selected distance is displayed on the scale through the base flange window. Preferably, a click mechanism is provided to enable click sensing in terms of angular elevation as the knob and adjustment member are rotated. The gripping surface of the knob may define an annular flange extending from the periphery of the knob over an outer surface of the base flange toward the lens-supporting tube. A retaining member such as a locking screw is positioned against the knob and threaded into a socket in the head of the elevation adjustment member, and the retaining member may be partially loosened to enable disengagement of mating knurled surfaces on the knob and head so these components can be rotationally disengaged during zeroing of the sight.

DESCRIPTION OF THE PREFERRED EMBODIMENT

Figure 1:
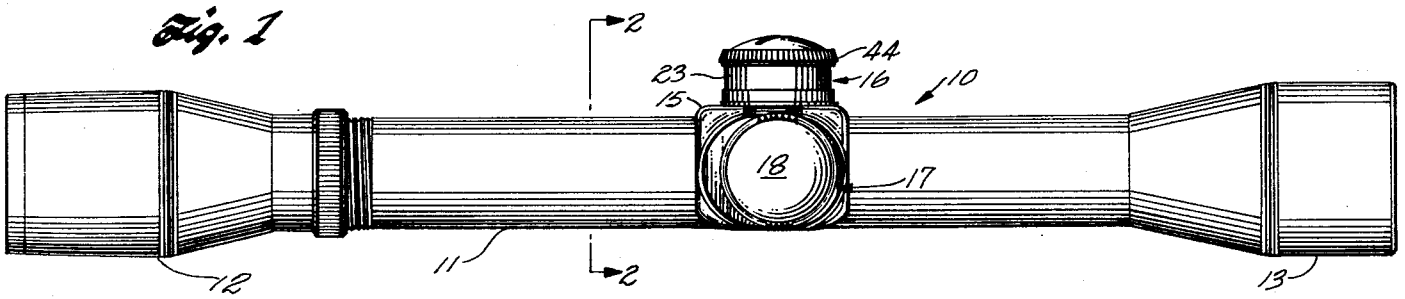
FIG. 1 is a side view of a riflescope incorporating an elevation adjustment assembly according to the invention.

FIG. 1 shows a riflescope 10 having central barrel or body tube 11 carrying at its opposite ends an ocular-lens housing 12 and an objective-lens housing 13. A mounting saddle 15 is centrally secured to body tube 11, and supports an elevation adjustment assembly 16 and a windage adjustment assembly 17. The windage adjustment may be of a conventional type enclosed by a threaded cap 18, and, for brevity, will not be described in greater detail.

The optical system of riflescope 10 may be conventional, and typically includes ocular and objective lens systems mounted in housings 12 and 13, and appropriate erector lenses 20 supported in a tubular cell 21 which is conventionally mounted within body tube 11 to be pivotally movable with respect to an optical axis of the riflescope to enable horizontal and vertical shifting of the target image.

The optical system also includes a reticle (not shown) which may be of a conventional post or crosshair type normally positioned at the ocular focal plane to be superimposed on the target image. This arrangement is well known in the art, and enables windage and elevation adjustments to be made by shifting the target image without moving the reticle from a central position in the shooter's field of view. Elevation adjustment assembly 16, however, is also usable with windage and elevation adjustments which involve physical movement of the reticle itself.

Referring to FIGS. 2–5, elevation adjustment assembly 16 includes a housing 23 having a horizontal base 24, an annular flange 25 extending upwardly from the base, and an internally threaded tubular extension 26 projecting downwardly from the base through circular openings 27 and 28 in mounting saddle 15 and body tube 11 respectively. Housing 23 is secured to the riflescope body tube by screws 30 threaded into mounting saddle 15, and a sealing gasket 31 is disposed between the underside of base 24 and the upper surface of the mounting saddle.

An opening 33 is formed through the rear of annular flange 25 to face the shooter's eye behind ocular-lens housing 12. Preferably, the opening is sealed by a transparent strip 34 (which may be a plastic material, or a thin glass shell) cemented to the inner surface of flange 25.

A stud 36 forms an elevation adjustment member for assembly 16, and the stud has an externally threaded shank 37 threaded through and extending slightly beyond the bore of tubular extension 26. A snap-ring retainer 38 is fitted in a groove at the lower end of shank 37, and the bottom of the shank bears against the upper surface of tubular cell 21 which carries the riflescope erector lenses.

Figure 4:
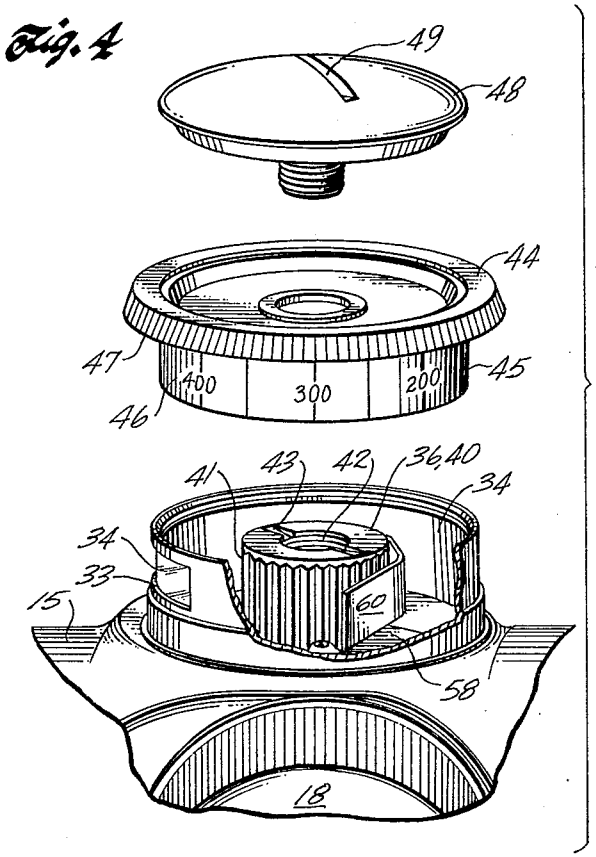
FIG. 4 is an exploded perspective view of the adjustment assembly.
Figure 3:
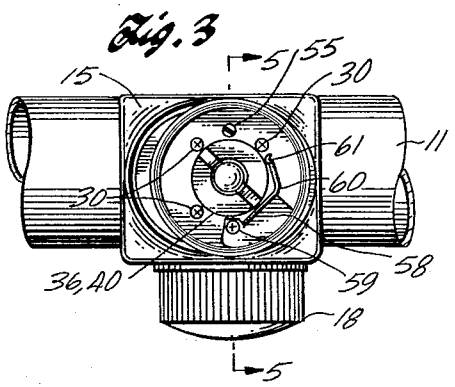
FIG. 3 is a top view of the elevation adjustment assembly with an adjustment knob removed.
Figure 2:
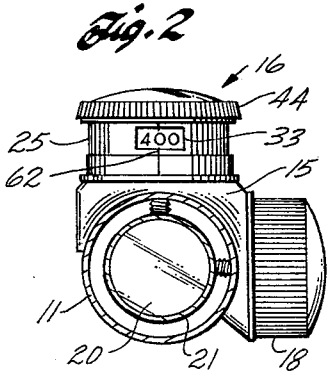
FIG. 2 is a sectional view on line 2—2 of FIG. 1.

Stud 36 has an enlarged cylindrical head 40, and an upright side surface 41 of the head is knurled (FIG. 4). A centrally positioned internally threaded socket 42 extends downwardly from the top of head 40, and a slot 43 is also formed in the top of the head to enable the stud to be rotated by a coin or screwdriver during initial installation.

Figure 5:
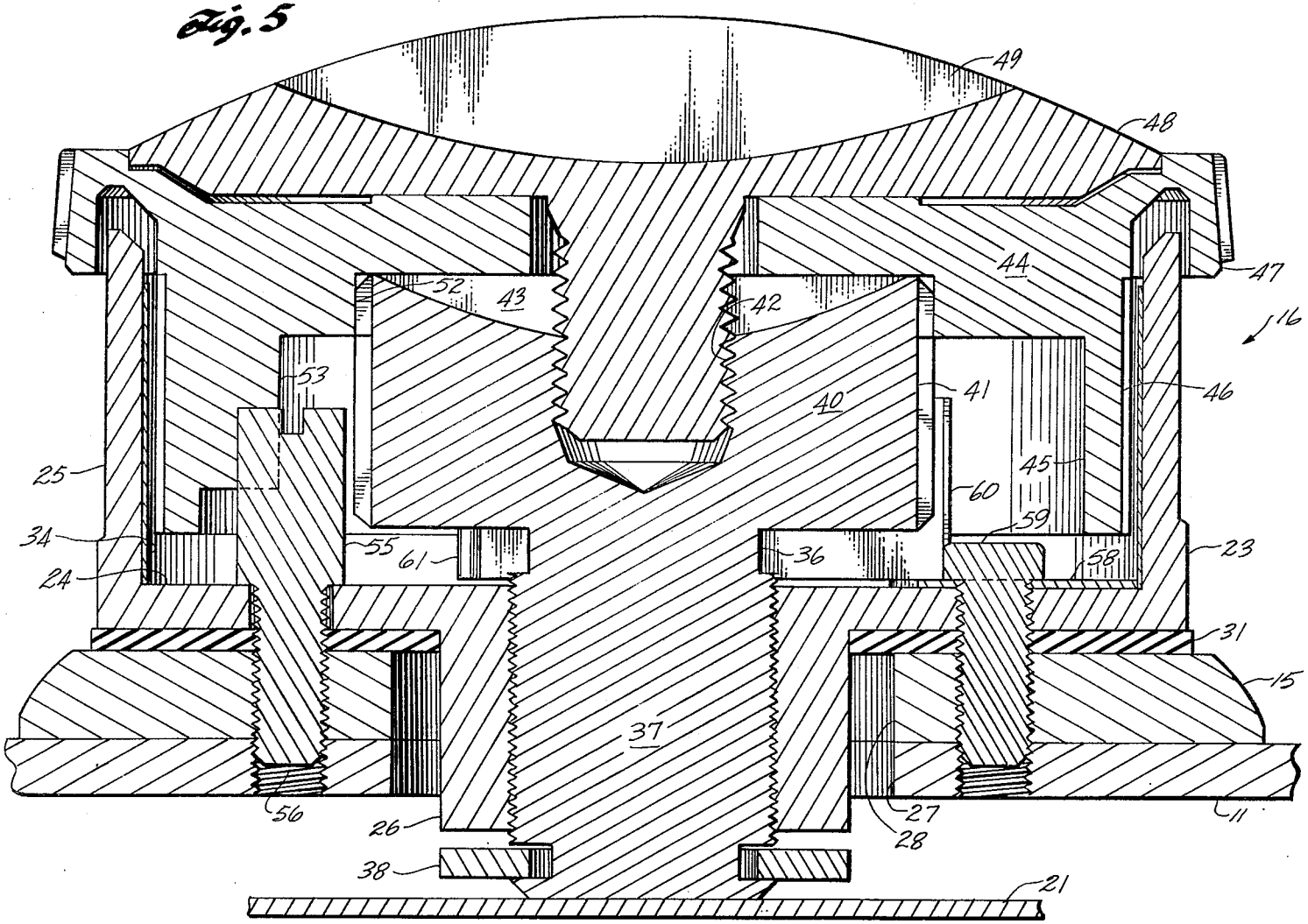
FIG. 5 is a sectional elevation on line 5—5 of FIG. 3.

A knob 44, best seen in FIGS. 4 and 5, defines a downwardly extending annular skirt 45. A distance scale 46, preferably calibrated in yards or meters, is printed or engraved around the outer surface of the skirt. An outer annular flange 47 extends downwardly from the periphery of the top of knob 44, and the outer surface of flange 47 is knurled to enable the knob to be readily grasped and rotated. The top surface of knob 44 is centrally recessed to receive the head of a retaining screw 48 which is threaded into socket 42 of stud head 40. A slot 49, of suitable width to receive a coin or screwdriver, is formed in the head of retaining screw 48.

Figure 6:
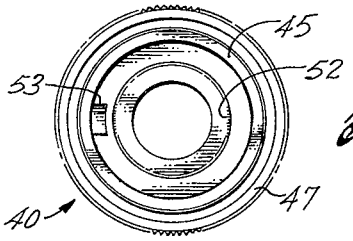
FIG. 6 is a bottom view of the adjustment knob.

Referring to FIGS. 5 and 6, the inner surface of knob 44 is recessed to define a generally cylindrical knurled surface 52 which fits snugly over and matingly engages with knurled surface 41 of stud head 40. Preferably, the knurl pitch of surface 52 is two or three times the pitch of knurled surface 41, enabling the angular position of the knob with respect to stud head 40 to be adjusted in small angular increments. A stop member 53 extends radially inwardly from the inner surface of knob 44. Preferably, the entire knob, including stop member 53, is integrally molded from a plastic material.

A stop pin 55 extends upwardly from base 24 of housing 23, and is secured to mounting saddle 15 by a threaded shank 56. As shown in FIG. 5, pin 55 interferes with stop member 53 to prevent continuous rotation of the knob. Less than one turn of the knob is adequate to provide a proper elevation adjustment over a full range of target distances, and the stops prevent loss of proper correlation between knob setting and sight elevation setting.

A metal "click" spring 58 has a flat base secured by a screw 59 against base 24 of housing 23, and the spring is bent at right angles to define a leaf 60 extending partly around the outer surface of stud head 40. An inward projection 61 mates with the notches of knurled surface 41 on head 40 to provide a "click" which is tactilly and audibly sensed by the shooter as the knob is rotated. The knurl pitch on knurled surface 41 of the stud head is chosen to provide a selected increment of elevation adjustment (in terms of minutes of angle) for each click.

It has been found that about three or four differently calibrated distance scales 46 are adequate to cover the vast majority of trajectories resulting from various rifle and ammunition combinations in common use today. If it is necessary to compensate for an unusual trajectory, the outer surface of annular skirt 45 can be left blank for custom calibration by the user. Knob 44 is an inexpensive molded assembly, and a plurality of knobs bearing different distance scales (or a blank scale) can economically be provided with the riflescope to insure that all trajectories are accommodated.

In use, the components just described are assembled as shown in FIG. 5, with retaining screw 48 threaded only slightly into socket 42 so knob 44 can be moved vertically in and out of engagement with knurled surface 41 of stud head 40. The riflescope is then zeroed in by firing at a known distance of say 100 yards. Elevation adjustments for the sight are made during this zeroing process by rotating stud 36 with knob 44 to vary the position of erector-lens cell 21. If several rotations of knob 44 are required to achieve zeroing of the sight, the knob is raised vertically to enable stop member 53 to clear stop pin 55.

When the reticle or target-image position is established to provide accurate setting at the known range, knurled surfaces 41 and 52 are disengaged by raising knob 44, and the knob is rotated until the known distance is displayed on distance scale 46 in alignment with an index or lubber line 62 (FIG. 2) marked on the outer surface of housing 23 above and below opening 33. The sight is thereafter adjusted for various ranges simply by rotating the knob to display the selected target distance in alignment with lubber line 62. This adjustment can be made with the rifle in a firing position because the distance scale is readily viewed by the shooter by raising the eye slightly above the ocular-lens end of the riflescope.

There has been described a novel elevation adjustment assembly for a riflescope, the assembly being configured to provide a protective enclosure for a distance scale, while still permitting the scale to be readily viewed by the shooter. Click adjustments are provided in addition to the visible distance scale, and a particular feature of the invention is that interchangeable distance scales may be quickly and easily installed in the field to accommodate ammunition changes. The assembly is readily adapted to any style of riflescope, and the flexibility provided by use of interchangeable distance scales enables accommodation of either standard or non-standard bullet trajectories.

What is claimed is:

1. In a firearm telescopic sight having a lens-supporting tube with ocular and objective lenses at opposite ends thereof, and including an internal means movably mounted within the tube for defining a line of sight for sighting targets at varying ranges, an improved external range adjustment assembly comprising:

a base secured to the tube, the base defining an upwardly extending annular flange having a transparent viewing portion facing the ocular-lens end of the sight to be visible when the sight is held in an aiming position;

a rotatable knob having an externally accessible gripping surface positioned above the base flange, and having a skirt fitted within the base flange, the skirt bearing markings forming a distance scale, a portion of the scale being viewable through the transparent viewing portion; and an elevation adjustment means having a head connected to the knob to rotate therewith, the adjustment means further having a portion extending into the lens-supporting tube in operation connection with said internal means, said portion being movable responsive to rotational movement of the knob and adjustment means to adjustably position the internal means whereby the sight is adjusted for use at a particular target distance by rotating the knob until said distance is displayed through the base flange window.

2. The assembly defined in claim 1 wherein the gripping surface of the knob is defined on an annular flange extending from the periphery of the knob over an outer surface of the base flange.

3. The assembly defined in claim 2 and further comprising a retaining means for releasably connecting the knob and the head of the elevation adjustment member.

4. The assembly defined in claim 3 wherein the knob and the head of the elevation adjustment means define mating knurled surfaces which lock the knob and head together rotationally when engaged.

5. The assembly defined in claim 4 wherein the head defines a threaded socket and the retaining member has a threaded portion engaged in the socket, the retaining member when partially unthreaded from the head to permitting disengagement of the knurled surfaces of the head and knob to permit zeroing of the sight without complete removal of the retaining member.

6. The assembly defined in claim 5 and further comprising click means cooperating with the elevation adjustment means for producing click sensing as the sight is adjusted.

7. The assembly defined in claim 1 and further comprising a click mechanism secured to the base and cooperating with the coupled knob and elevation adjustment means to provide click sensing in terms of angular movement as the knob and adjustment means are rotated.

* * * * *

UNITED STATES PATENT AND TRADEMARK OFFICE

CERTIFICATE OF CORRECTION

PATENT NO. : 3,990,155

DATED : November 9, 1976

INVENTOR(S) : Alfred A. Akin, Jr. and Harold A. Miller

It is certified that error appears in the above-identified patent and that said Letters Patent are hereby corrected as shown below:

Column 4, line 63, "operation" should read -- operative --. Column 5, line 8, "means" should read -- member --; lines 9 and 10, "member" should read -- means --. Column 6, line 2, after "head" delete "to".

Signed and Sealed this

Fifteenth Day of February 1977

[SEAL]

*Attest:*

RUTH C. MASON
*Attesting Officer*

C. MARSHALL DANN
*Commissioner of Patents and Trademarks*